US008381619B2

(12) United States Patent
Hung

(10) Patent No.: US 8,381,619 B2
(45) Date of Patent: Feb. 26, 2013

(54) FASTENING DEVICE FOR FASTENING LOCKNUTS

(75) Inventor: Tzu-Hsiu Hung, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 218 days.

(21) Appl. No.: 12/975,375

(22) Filed: Dec. 22, 2010

(65) Prior Publication Data

US 2011/0265612 A1 Nov. 3, 2011

(30) Foreign Application Priority Data

Apr. 30, 2010 (CN) ..... 2010 2 0177240 U

(51) Int. Cl.
*B25B 17/00* (2006.01)
*B25B 23/02* (2006.01)
*B25B 13/48* (2006.01)

(52) U.S. Cl. ..... 81/57.22; 81/57.32

(58) Field of Classification Search ..... 81/57.22, 81/57.3, 57.31, 57.32, 57.36, 56, 57
See application file for complete search history.

(56) References Cited

U.S. PATENT DOCUMENTS

| | | | | |
|---|---|---|---|---|
| 5,074,170 | A * | 12/1991 | Shirley | 81/57.3 |
| 6,134,989 | A * | 10/2000 | Stevens | 81/57.22 |
| 6,543,314 | B1 * | 4/2003 | Hoyt | 81/57.29 |
| 7,637,182 | B1 * | 12/2009 | Long | 81/57.22 |
| 7,926,388 | B2 * | 4/2011 | Lu | 81/57.36 |
| 2006/0169107 | A1 * | 8/2006 | Taniguchi et al. | 81/57.22 |
| 2009/0178516 | A1 * | 7/2009 | Lu | 81/57.22 |
| 2010/0175511 | A1 * | 7/2010 | Shortridge | 81/57.22 |

* cited by examiner

*Primary Examiner* — David B Thomas
(74) *Attorney, Agent, or Firm* — Altis Law Group, Inc.

(57) ABSTRACT

A fastening device used to fasten two locknuts to an object simultaneously includes a pedestal defining a first sliding groove, a pair of fixing blocks, a pair of rotating elements, a pair of first gear wheels and a second gear wheel. The fixing blocks are received and fixed in the first sliding groove. Each of the fixing blocks defines a through hole. Each of the rotating elements includes an operating portion and a shaft portion received in the through hole. Each of the pair of gear wheels includes a gear body attached to corresponding one of the shaft portions respectively and a sleeve protruding from the gear body and snugly receiving one of the locknuts. The second gear wheel is attached to the pedestal and engaging the pair of first gear wheels to achieve synchronous movements of the pair of first gear wheels.

4 Claims, 7 Drawing Sheets

FASTENING DEVICE FOR FASTENING LOCKNUTS

BACKGROUND

1. Technical Field

The present disclosure generally relates to fastening devices for fastening locknuts.

2. Description of Related Art

Generally, communication devices, such as set-top boxes, include a plurality of connectors fixed on backboards for communicating with other communication devices. Please refer to FIGS. 1 and 2, two connectors 12 are fixed to a backboard 10 by fastening two locknuts 14. However, the locknuts 14 must be fastened one by one and ultimately would be fastened at different angles, which would result in different locking forces on the backboard 10, thereby the backboard 10 being distorted.

Therefore, a need exists in the industry to overcome the described problem.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
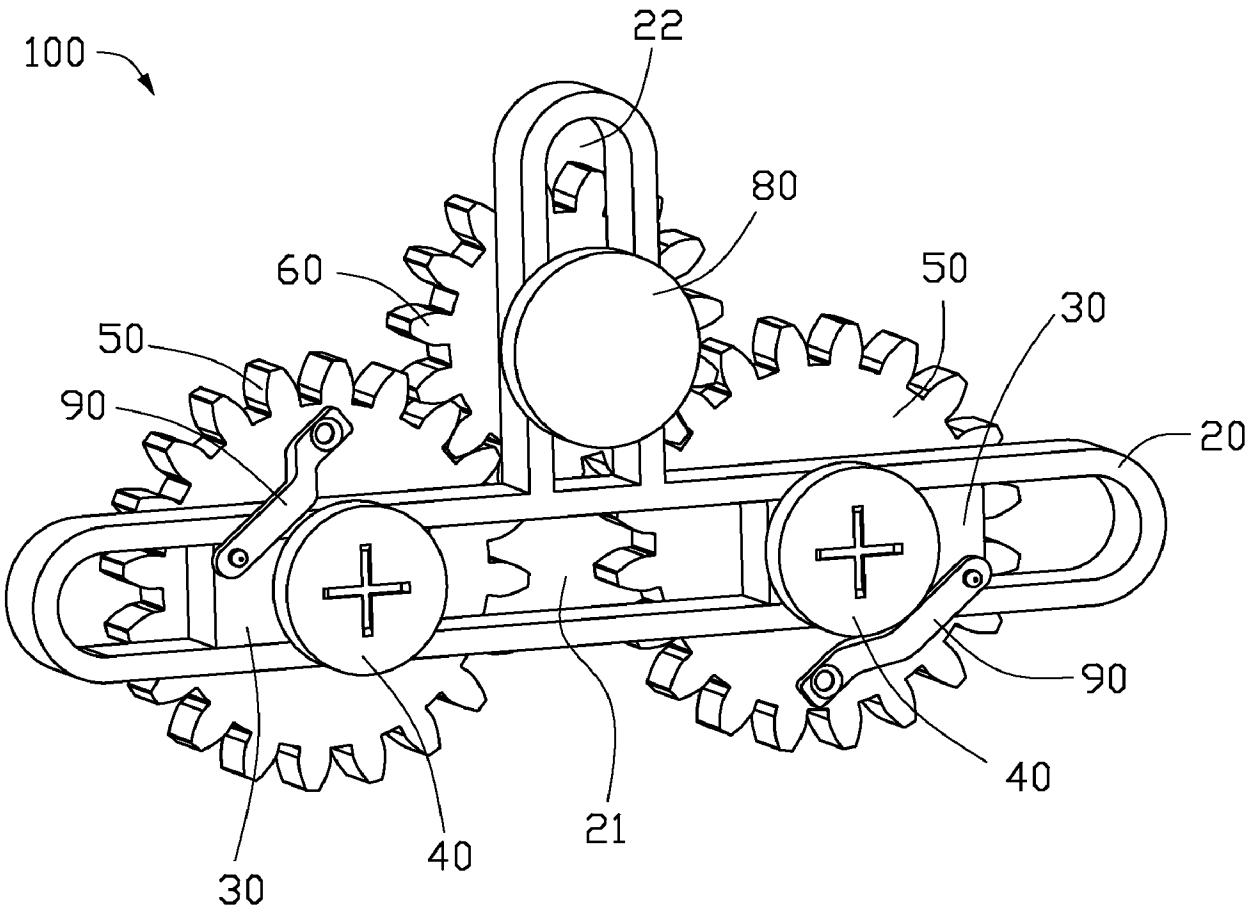
FIG. 1 is a perspective view of a fastening device of an exemplary embodiment of the disclosure.
Figure 2:
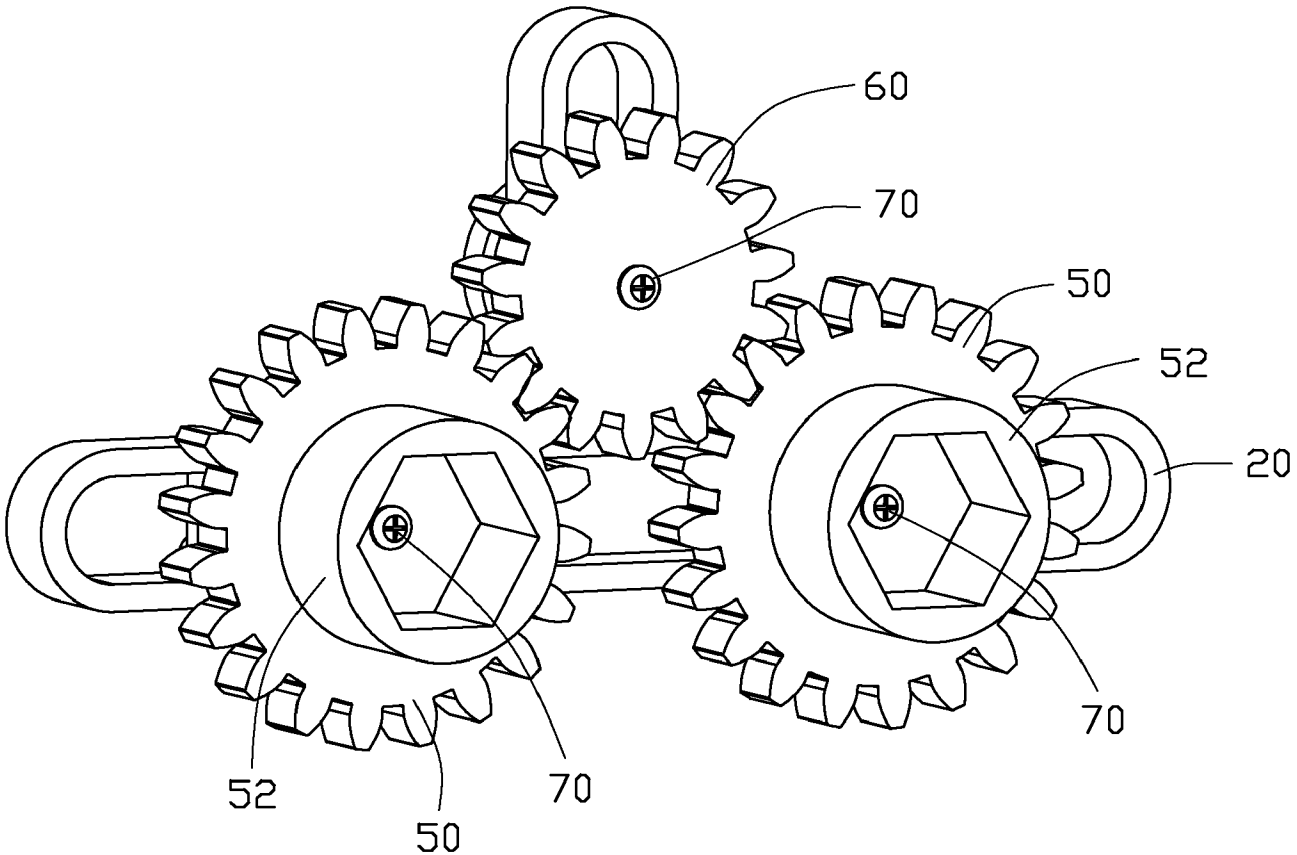
FIG. 2 is similar to FIG. 1, but viewed from another aspect.
Figure 3:
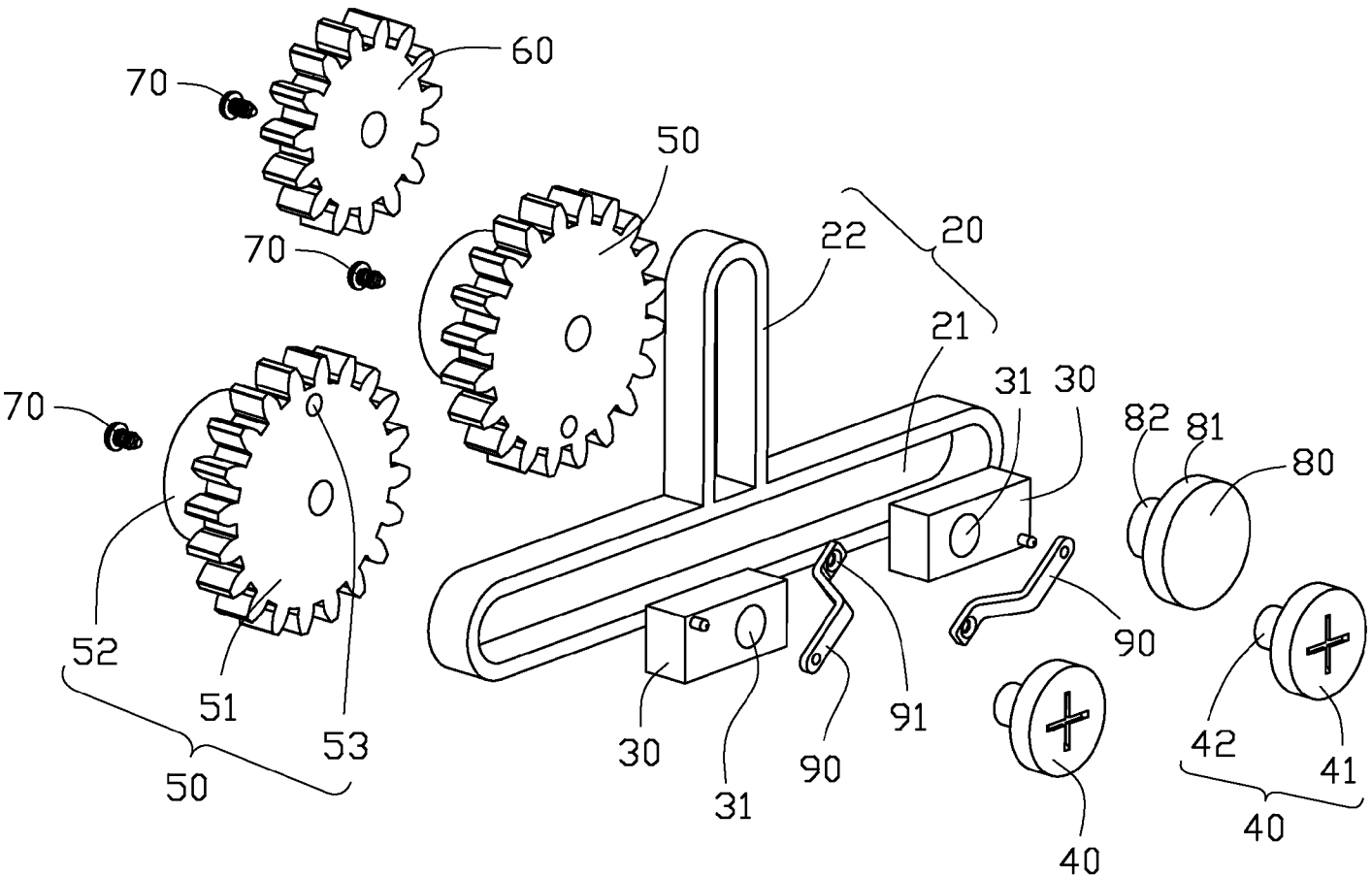
FIG. 3 is an exploded perspective view of the fastening device of FIG. 1.
Figure 4:
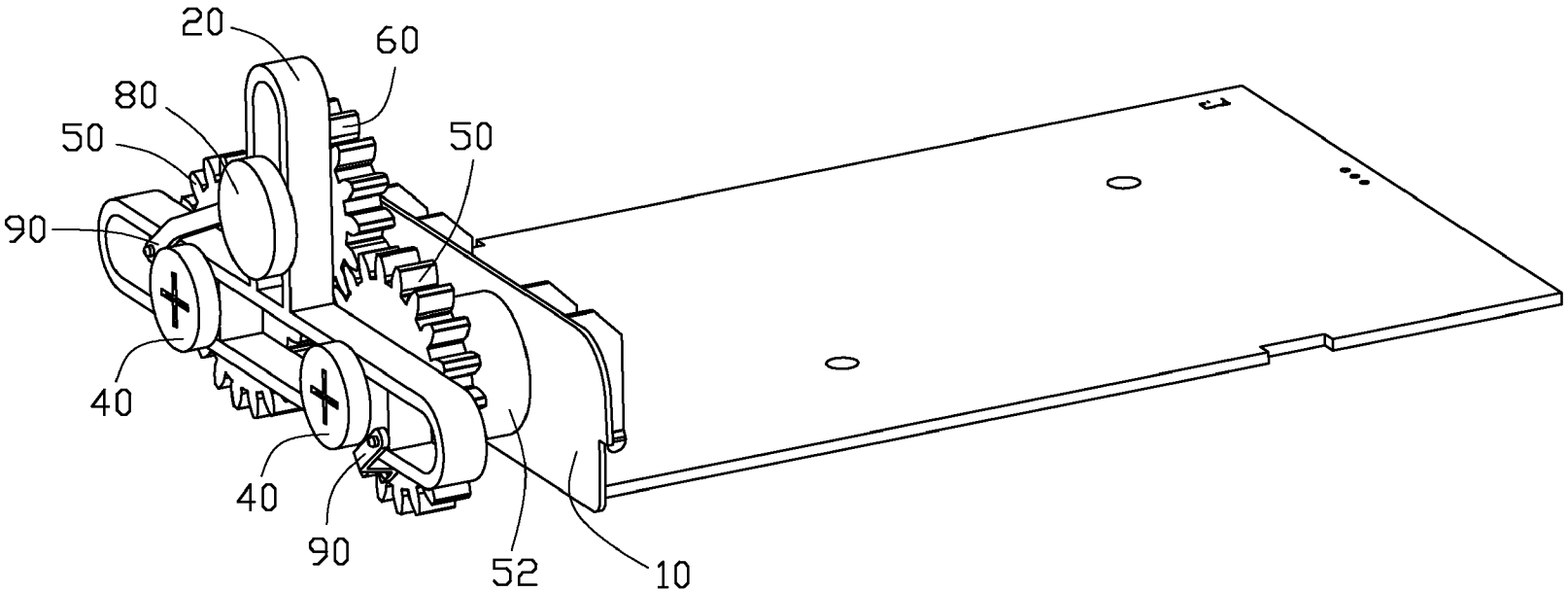
FIG. 4 is a perspective view of the fastening device of FIG. 1 using on a backboard of an object.
Figure 5:
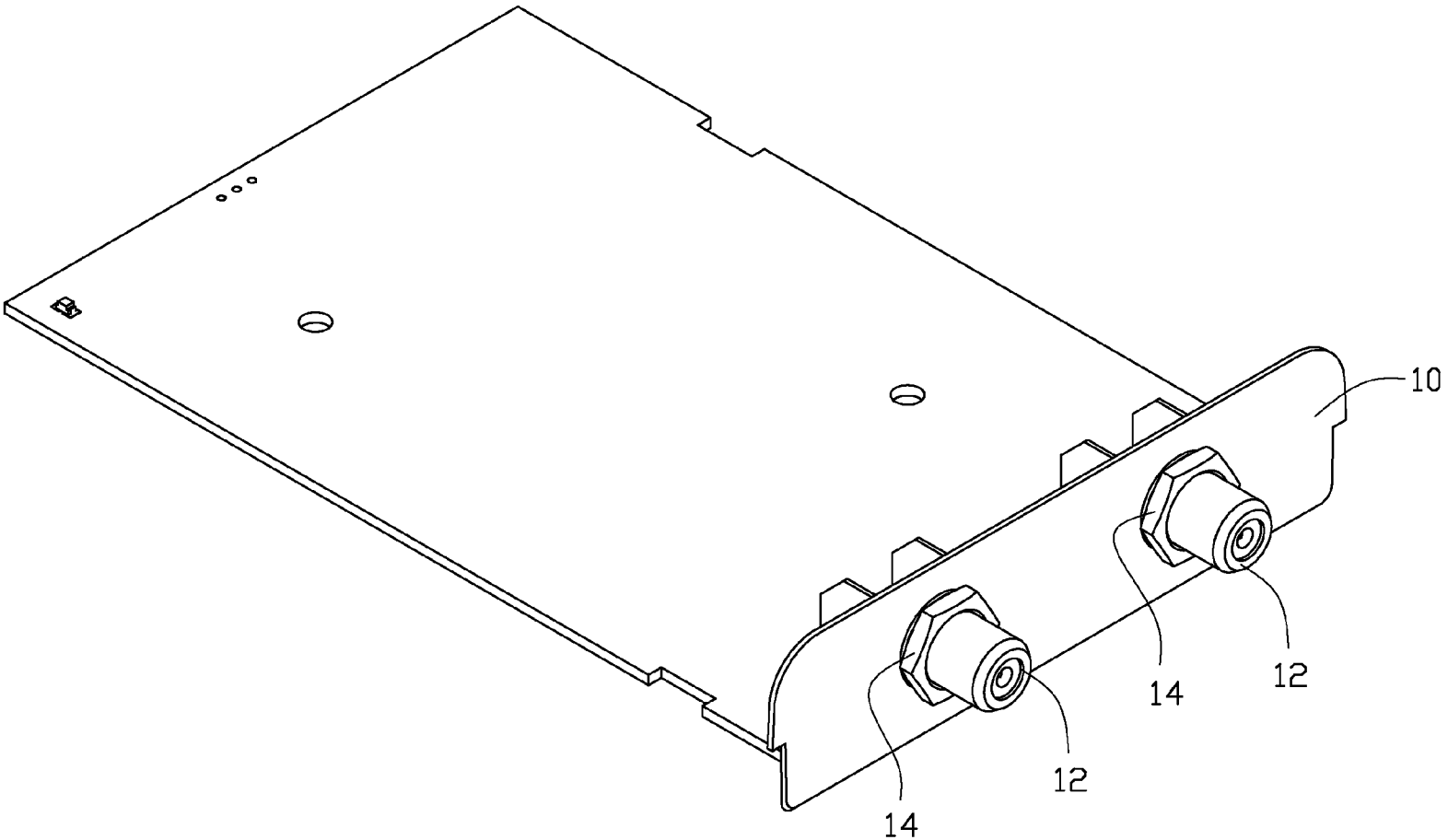
FIG. 5 is perspective view of the object of FIG. 4 after fastening locknuts by the fastening device of FIG. 1.

Referring to FIGS. 3-5, a fastening device 100 is illustrated, which is used to fasten two locknuts 14 (shown in FIG. 7) to an object simultaneously. The fastening device 100 comprises a pedestal 20, a pair of fixing blocks 30, a pair of rotating elements 40, a pair of first gear wheels 50 and a second gear wheel 60.

The pedestal 20 defines a first sliding groove 21 and a second sliding groove 22 perpendicular to the first sliding groove 21. The pair of fixing blocks 30 are received and fixed in the first sliding groove 21. Each of the fixing blocks 30 defines a through hole 31. In this embodiment, the fixing blocks 30 both tightly contact with the first sliding groove 21 to be firmly secured to the pedestal 20.

Each of the pair of rotating elements 40 comprises an operating portion 41 disposed on one side of the pedestal 20 and a fixing shaft 42 protruding from corresponding of the operating portion 41 and received in the corresponding through hole 31. The fixing shafts 42 match with the through holes 31 in clearance fit, therefore, the rotating elements 40 can rotate in the through hole 31. The first gear wheels 50 are disposed on the other side of the pedestal 20. Each of the first gear wheels 50 comprises a gear body 51 attached to corresponding one of the fixing shafts 42 respectively and a sleeve 52 protruding from the gear body 51 and snugly receiving one of the locknuts 14. In this embodiment, the locknuts 14 are polygonal shaped, as that of inner surfaces of the sleeves 52. The gear bodies 51 are fixed to the fixing shafts 42 via two screws 70 passing through the gear bodies 51 and screwed in the fixing shafts 42 respectively.

The second gear wheel 60 is attached to the pedestal 20 and synchronously engages with the pair of first gear wheels 50 to achieve synchronous movements of the pair of first gear wheels 50. In this embodiment, the fastening device 100 further comprises a securing element 80 used to secure the second gear wheel 60 to the pedestal 20. The securing element 80 passes through the second sliding groove 22 and is fixed to the second gear wheel 60. The securing element 80 comprises a shaft portion 82 and a head portion 81. The shaft portion 82 is received in the second sliding groove 22 in clearance fit and fixed to the second gear wheel 60 by a screw 70 passing through the second gear wheel 60 and screwed in the shaft portion 82. The head portion 81 is blocked on one side of the pedestal 20 away from the second gear wheel 60.

The fastening device 100 further comprises a pair of calibrating tabs 90. One end of each of the calibrating tabs 90 is pivoted to corresponding one of the fixing blocks 30. The other end of each of the calibrating tabs 90 is movably positioned in corresponding of the gear bodies 51 of the first gear wheels 50. When the calibrating tabs 90 are positioned in the gear bodies 51 respectively, the inner surfaces of the sleeves 52 are positioned in a same angle. Each of the gear bodies 51 defines a positioning hole 53. Each of the calibrating tabs 90 comprises a protruding portion 91 to match with corresponding of the positioning holes 53. When the first gear wheels 50 are rotated, the protruding portions 91 move out from the positioning holes 53 due to flexibility of the calibrating tabs 90.

Figure 6:
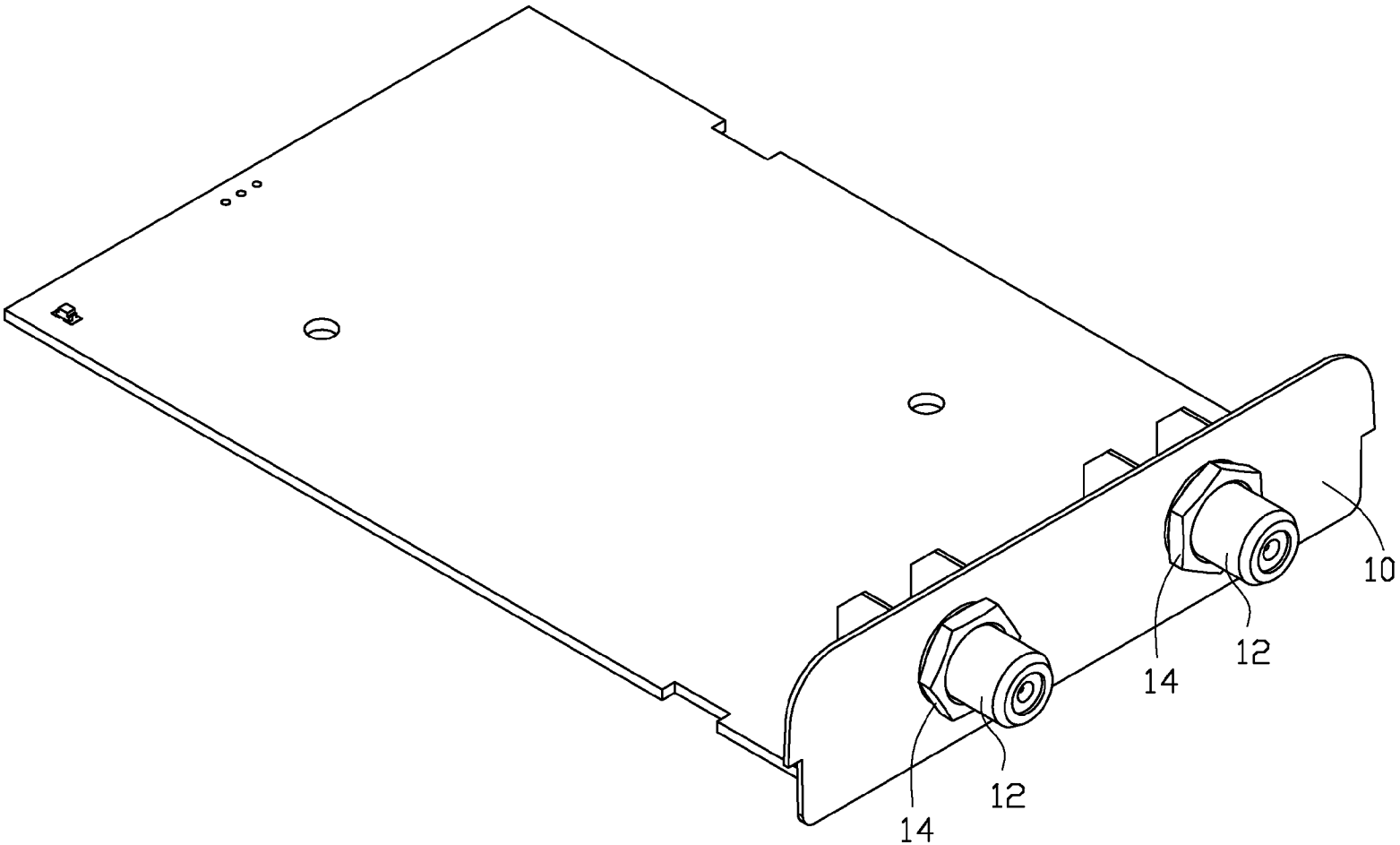
FIG. 6(PRIOR ART)
FIG. 6 is a schematic drawing of two locknuts fastened on a backboard of a communication device in prior art.
Figure 7:
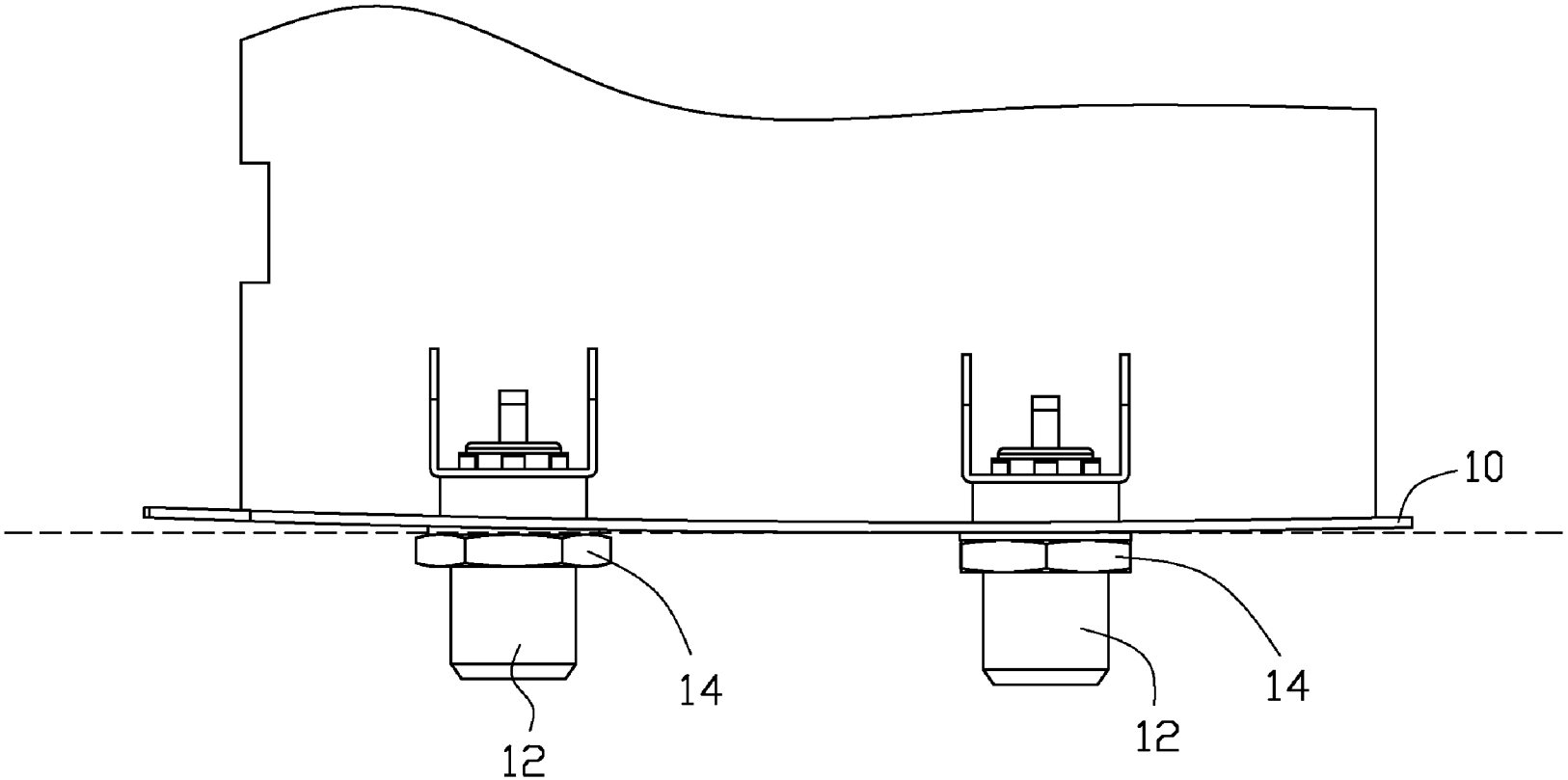
FIG. 7(PRIOR ART)
FIG. 7 is a planar view of FIG. 6, showing the backboard being distorted after fastening the locknuts.

Referring to FIG. 6 and FIG. 7, the fastening device 100 is used to fasten the locknuts 14 to a backboard 10 of the object to fix two connectors 12. Before fastening the locknuts 14, the locknuts 14 are placed into the sleeves 52 and snugly match with the inner surfaces of the sleeves 52. The protruding portions 91 are positioned in the positioning holes 53 to obtain a same angle of the two locknuts 14. The sleeves 52 are placed over the connectors 12. During fastening of the locknuts 14, an operator uses a screw driver to drive one of the operating portions 41, thereby the first gear wheels 50 synchronously rotating via the second gear wheel 60 engaged therebetween. Therefore, the operator can fasten the two locknuts 14 at same time, and the backboard 10 would not be distorted due to the synchronous rotation of the first gear wheels 50.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A fastening device, used to fasten two locknuts to an object simultaneously, and comprising:

a pedestal, defining a first sliding groove;

a pair of fixing blocks, received and fixed in the first sliding groove, each of the fixing blocks defining a through hole;

a pair of rotating elements, each comprising an operating portion disposed on one side of the pedestal and a fixing shaft protruding from the operating portion and received in a corresponding one of the through holes;

a pair of first gear wheels, disposed on the other side of the pedestal, each of the first gear wheels comprising a gear body attached to a corresponding one of the fixing shafts and a sleeve protruding from the gear body and snugly receiving one of the locknuts;

a second gear wheel, attached to the pedestal and synchronously engaging the pair of first gear wheels to achieve synchronous movements of the pair of first gear wheels; and a pair of calibrating tabs, one end of each of the calibrating tabs pivoted to a corresponding one of the fixing blocks, and the other end of each of the calibrating tabs movably positioned in a corresponding one of the gear bodies, wherein inner surfaces of the sleeves are polygon-shaped, and when the calibrating tabs are positioned in the gear bodies respectively, the sleeves are positioned in a same angle.

2. The fastening device as claimed in claim 1, wherein each of the gear bodies defines a positioning hole, and each of the calibrating tabs comprises a protruding portion to match with the corresponding one of the positioning holes.

3. The fastening device as claimed in claim 2, further comprising a securing element used to secure the second gear wheel to the pedestal, wherein the pedestal defines a second sliding groove perpendicular to the first sliding groove, and the securing element passes through the second sliding groove and is fixed to the second gear wheel.

4. The fastening device as claimed in claim 3, wherein the securing element comprises a shaft portion and a head portion, the shaft portion is snugly received in the second sliding groove in clearance fit and fixed to the second gear wheel, and the head portion is blocked on one side of the pedestal away from the second gear wheel.

* * * * *